US005519673A

United States Patent [19]

Uehara et al.

[11] Patent Number: 5,519,673

[45] Date of Patent: May 21, 1996

[54] CLOCK WITH CONSTELLATION DISPLAY

[75] Inventors: Hideo Uehara, Sayama; Mamoru Shibata, Omiya, both of Japan

[73] Assignee: Citizen Watch Co., Ltd., Tokyo, Japan

[21] Appl. No.: 357,093

[22] PCT Filed: Oct. 6, 1992

[86] PCT No.: PCT/JP92/01296

§ 371 Date: Jun. 7, 1993

§ 102(e) Date: Jun. 7, 1993

[87] PCT Pub. No.: WO93/07544

PCT Pub. Date: Arp. 15, 1993

Related U.S. Application Data

[63] Continuation of Ser. No. 66,166, Jun. 7, 1993, abandoned.

[30] Foreign Application Priority Data

Oct. 8, 1991 [JP] Japan ..... 3-260696
Oct. 25, 1991 [JP] Japan ..... 3-279978

[51] Int. Cl.[6] ..... G04B 19/26
[52] U.S. Cl. ..... 368/15; 368/20
[58] Field of Search ..... 368/14–20

[56] References Cited

U.S. PATENT DOCUMENTS

| | | | |
|---|---|---|---|
| 2,657,525 | 11/1953 | Allen | 368/15 |
| 4,731,767 | 3/1988 | Uehara | 368/15 |
| 4,933,920 | 6/1990 | Sternberg | 368/15 |
| 4,972,392 | 11/1990 | Wang | 368/21 |

FOREIGN PATENT DOCUMENTS

| | | |
|---|---|---|
| 25-4496 | 7/1950 | Japan . |
| 37-22185 | 8/1962 | Japan . |
| 38-25930 | 11/1963 | Japan . |
| 49-106365 | 9/1974 | Japan . |
| 51-7109 | 2/1976 | Japan . |
| 54-17884 | 2/1979 | Japan . |
| 59-141365 | 9/1984 | Japan . |
| 59-176991 | 11/1984 | Japan . |
| 1-217289 | 8/1989 | Japan . |

*Primary Examiner*—Vit W. Miska
*Attorney, Agent, or Firm*—Finnegan, Henderson, Farabow, Garrett & Dunner

[57] ABSTRACT

A clock is formed by a front frame (11) for forming a clock body, a back frame (35) fixed with the former, a transparent dial plate (17) fixed with the front frame and having scale marks on the periphery for representing month and day, a constellation disc (15) rotatably held by the dial plate and having an annular toothed member (63) on the circumference thereof, a support member (71, 79) provided on the back surface of the dial plate for rotatably guiding and supporting the constellation disc, and a drive mechanism (75) provided on the back surface of the dial plate for driving the annular toothed member of the constellation disc while engaging with the toothed member. Also, in a clock with a constellation display having a representation part (27) for a solar time and a sidereal time, a driving device for the clock with a constellation display is disclosed in which a solar time display and a sidereal time display are driven by a single oscillation circuit (203) comprising a single oscillator (201), and frequency dividers (205, 207, 209, 211) are provided for dividing a frequency of the oscillation circuit into predetermined frequencies suitable for displaying the solar time and the sidereal time, respectively.

17 Claims, 11 Drawing Sheets

CLOCK WITH CONSTELLATION DISPLAY

This application is a continuation of application Ser. No. 08/066,166, filed Jun. 7, 1993, now abandoned.

FIELD OF THE INVENTION

The present invention relates to a clock with a constellation display for displaying a solar time and a sidereal time, particularly to a clock with a constellation display having no hour hand or minute hand.

BACKGROUND OF THE INVENTION

A clock with a constellation display has been known for displaying constellations in accordance with a time. The prior art constellation display clock has an hour hand, a minute hand, and possibly a second hand at a rotational center of the celestial sphere and a constellation disc rotates in accordance with the movement of these hands to display constellations visible at that instant.

However, since the hands representing time radially extend from the rotational center of the celestial sphere in the prior art constellation display clock, fixed stars, particularly those in the vicinity of the center of the celestial sphere, for example, the Pole Star is concealed by a rotating central portion of the hand. Accordingly, this is not satisfactory as a constellation disc.

Since the prior art constellation display clock has no backlight or one with insufficient illumination effect, a uniform luminous intensity cannot be obtained all over the constellation disc.

In the prior art, there is no constellation display clock having a function for representing a solar time as well as a sidereal time, in addition to a function for displaying constellations. On the other hand, in a prior art clock having a function for representing a solar time and a sidereal time but without a constellation disc, the solar time and the sidereal time are operated by individual oscillation circuits, respectively. This is because, while the solar time has a slight difference from the sidereal time (the sidereal time is shorter than the solar time, i.e., passes faster, by about 4 minutes per day), a time ratio between the solar time and the sidereal time cannot be approximated at a higher accuracy by a simple integer ratio, and because the sidereal time clock is mainly utilized for a measurement use in which even a small error caused by the use of the common single oscillator cannot be permitted.

In the prior art constellation display clock, it is impossible to solely control and rotate a constellation disc because the constellation disc is driven by a torque from the clock. Also the clock has a structure by which the positional adjustment of the constellation disc itself can be carried out only manually. A deviation between the constellation disc and the sidereal time is manually corrected.

As stated above, since a prior art clock having a function for representing solar time and sidereal time requires two oscillators and circuits, a control system thereof becomes complicated and expensive. In addition, since the control of the constellation disc independent from other parts is impossible in the prior art constellation display clock, various functions of the clock accompanying the rotation of the constellation disc are not satisfactorily achieved.

An object of the present invention is to solve the above problems inherent to the prior art and to provide a constellation display clock having no hands at the center of the constellation disc and having a simple driving means for accurately moving the constellation disc in accordance with the passage of time.

Another object of the present invention is to provide a constellation disc having a backlight on the back side of a constellation disc whereby the light emitted therefrom substantially homogeneously illuminates all over the constellation disc.

A further object of the present invention is to provide a constellation display clock which represents a solar time and a sidereal time at an accuracy sufficient for the practical use of the constellation display clock while using a single oscillator.

A further object of the present invention is to provide a constellation display clock having, in addition to a function for always displaying an accurate position of the constellations while corresponding the constellation disc with a sidereal time, various functions for rotating the constellation disc by independently controlling the rotation of the constellation disc while counting sidereal time and the position of the constellation disc.

DISCLOSURE OF THE INVENTION

To achieve the above objects, according to the present invention, a clock with a constellation display is provided, comprising a front frame for forming a clock body, a back frame fixed with the former, a transparent dial plate fixed with the front frame and having scale marks on the periphery for representing month and day, a constellation disc rotatably held by the dial plate and having an annular toothed member on the circumference thereof, a support member provided on the back surface of the dial plate for rotatably guiding and supporting the constellation disc, and a drive mechanism provided on the back surface of the dial plate for driving the annular toothed member of the constellation disc while engaging with the same.

A light source is provided between the front and back frames for illuminating the constellation disc. The front frame, dial plate, constellation disc, light source and back frame are arranged in this order as seen from the front side. On the back side of the constellation disc are provided a diffusion means for substantially homogeneously diffusing the illumination light from the light source and a reflection means for reflecting the illumination light from the light source to the constellation disc. A single fluorescent light lamp can be used as the light source. The fluorescent light lamp is secured on a back cover having a mount for the fluorescent light lamp, and the back cover itself is mounted on the back frame in a readily detachable manner.

The constellation disc drive mechanism is fixed on the back side of the front frame, and includes a stepping motor, a timing pulley connected with an output shaft of the stepping motor and driven in rotation thereby, and a timing belt driven by the timing pulley and engaging with the toothed member of the constellation disc.

The support member for rotatably guiding and supporting the constellation disc has a movable guide pulley and a stationary guide pulley, in which the movable guide pulley is pivoted to the front frame while movable radially inward by a predetermined distance.

According to the present invention, since the movement of the constellation disc is independent from the time representation part, there is no need to provide hands such as an hour hand or a minute hand in the center thereof, whereby the driving system for the constellation disc may be provided other than in the center thereof, that is, on the circumference as an annular toothed member. All the constellation disc then including the center thereof is completely visible through the transparent dial plate. The drive mechanism for the constellation disc can be effectively arranged in a vacant space in the clock frame from which power is readily transmitted to the circumferential toothed member.

The constellation disc is illuminated from the back side by the backlight so that the light is effectively and homogeneously distributed all over the disc surface through the diffusion means and the reflection means.

The number of pulses of the stepping motor corresponding to one turn of the constellation disc is properly defined by taking a sidereal time into account, which is reliably transmitted to the constellation disc through the timing mechanism.

By supporting the constellation disc by the movable guide pulley movable in the radial direction, a positional deviation of the constellation disc due to impulse, thermal expansion or shrinkage is effectively absorbed.

According to another aspect of the present invention, in a constellation display clock having a representation part for a solar time and a sidereal time, a driving device for the constellation display clock is provided, comprising a single oscillation circuit with a single oscillator for driving the representation part for a solar time and a sidereal time and frequency dividers for dividing an output frequency from the oscillation circuit into predetermined frequencies suitable for representing the solar time and the sidereal time, respectively.

A controller is provided for controlling a rotational speed of the constellation disc, whereby the constellation disc itself can be independently subjected to a quick rotation or a stop motion.

The deviation between the sidereal time and the position of the constellation disc can be automatically corrected by the comparison of a sidereal counter with a constellation disc counter.

Thereby, the solar time clock part and the sidereal time clock part receive an output from the single oscillator (oscillation circuit), which is divided into predetermined frequencies by the respective frequency dividers. Accordingly, there is no need for exclusive oscillators as those of the prior art.

Since the constellation disc automatically resumes the originally set position, it can be conveniently used.

BEST MODES FOR CARRYING OUT THE INVENTION

Figure 1:
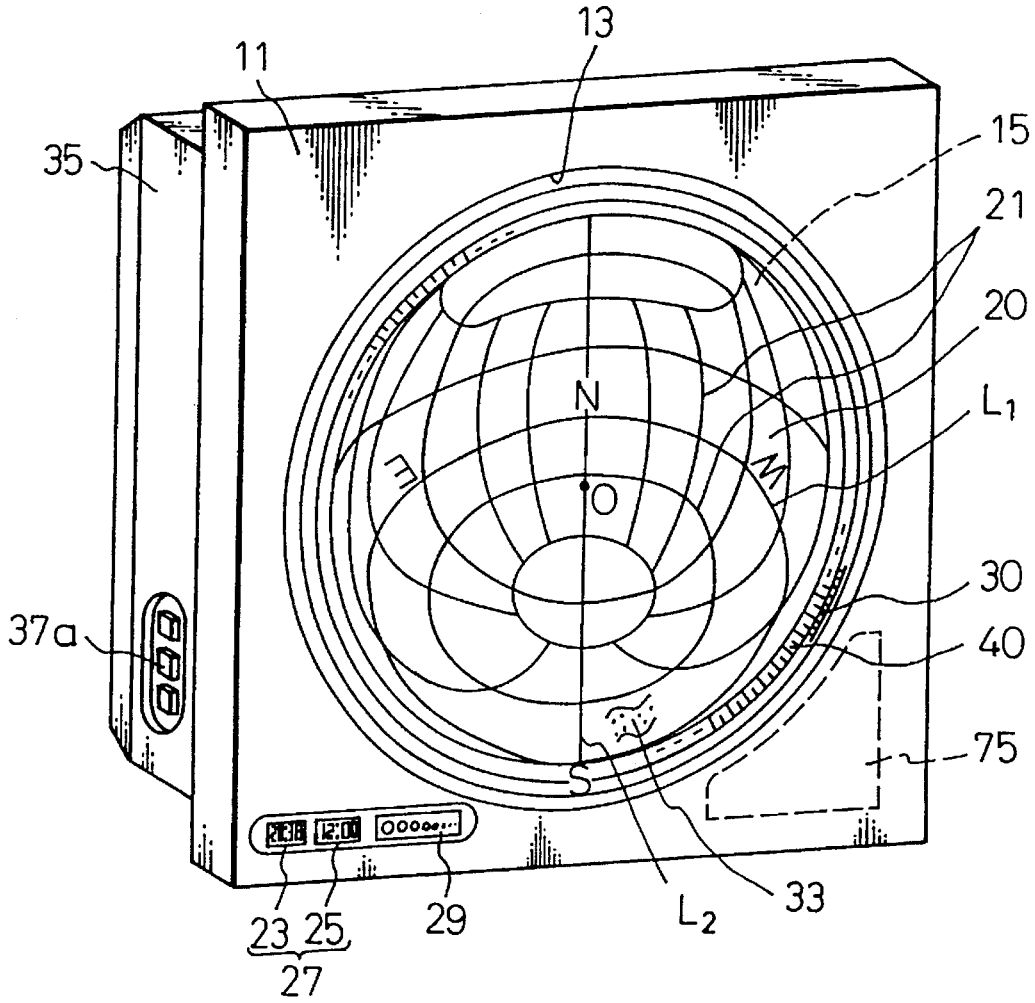
FIG. 1 is a front perspective view illustrating an overall configuration of a constellation display clock according to the present invention.

The preferred embodiments of the present invention will be described below with reference to the drawings.

One embodiment of a constellation clock (a clock with a constellation display) is illustrated in FIGS. 1 through 8, by which a rough structure of the constellation clock (a clock with a constellation display) according to the present invention will be first explained. In the illustrated embodiment, a circular opening 13 is formed in the central area of a front frame 11 of rectangular or square shape. A constellation disc 15 is positioned in rotation behind a transparent dial plate 17 fixed onto the front frame 11. Scale marks 30 representing months and days in one year are provided on the dial plate 17 in the peripheral region of the opening 13. A plurality of azimuth-latitude lines 21 are depicted in the central region of the dial plate 17 for recognizing an apparent azimuth and altitude of stars.

In the illustrated embodiment, a rotational center 0 of the constellation disc 15 coincides with a center of the clock, which corresponds to a celestial north pole. The constellation disc 15 covers all over a scope of a celestial sphere visible at lat. 35° N. That is, a range represented on the constellation disc 15 is from declination of −55° 34' 24" to declination of +90° (celestial north pole) including an average atmospheric refraction at lat. 35° N. In the illustrated embodiment, a rotational direction of the constellation disc 15 is counterclockwise. A range inside of a horizon L1 of the dial plate 17 shows a scope of celestial sphere visible at lat. 35° N and azimuth symbols (W, N, E, S) 20 are written directly outside of the horizon L1. Note that, while an azimuth-latitude line 21 is depicted outside of the horizon L1, this is for the purpose of simultaneously knowing the constellation arrangement except for circumpolar stars at a point opposite side of the earth.

The transparent constellation disc 15 is formed by a material having a diffusionability and transparency so that fixed stars, constellation clusters, the Milky Way or the like (denoted as 33) printed on the front surface of the disc are luminescent by an emitted light (described later) from the back side of the constellation disc.

Scale marks 40 for declination (24 hour representation from 0 o'clock to 23 o'clock) are provided in the vicinity of the periphery of the constellation disc 15, in which the declination scale mark 40 positioned directly beneath the meridian L2 on the dial plate 17 displays a present sidereal time. It is possible to initialize a rotational angular position of the constellation disc 15 or adjust month, day and time by coinciding an optional declination scale mark 40 with a corresponding month-day scale mark 30. In order to carrying out the accurate adjustment, it is necessary to take a time differential due to a difference to a reference longitude for a standard time (corresponding to 135° east longitude in Japan) and, more strictly, also an annual correcting value for a sidereal time variable in accordance with years must be taken into account.

A time representation part 27 is provided at the lower left corner of the front frame 11, as seen from the front side, including a display 23 for representing a solar time (usual 24 hour time) and a display 25 for representing a sidereal time (24 hour system) having an intimate relationship with the constellation arrangement. A light transmission type magnitude scale 29 is provided adjacent to the right side of the time representation part 27. This magnitude scale 29 is formed by a row of small circles, each having a different size and arranged in series according to an order of size, for displaying typical magnitudes of fixed stars in the constellation disc 15. That is, the fixed stars are represented in finer magnitudes while referring to circles each having a size corresponding to the respective small circle so that a magnitude of a certain fixed star can be defined in detail by finding the small circle in the magnitude scale 29 corresponding to said fixed star.

A driving part 75 (described later) is arranged at the lower right corner on the back side of the front frame 11, for driving the constellation disc 15 in rotation. A back frame 35 is attached to the back surface of the front frame 11 to form a clock body frame. Switches 37*a*, 37*b* are provided on the respective lateral sides of the back frame 35 for correcting times, operating the constellation disc 15 or lighting an illumination part (described later). An outline external appearance of the constellation display clock of the present invention is as described above.

Figure 2:
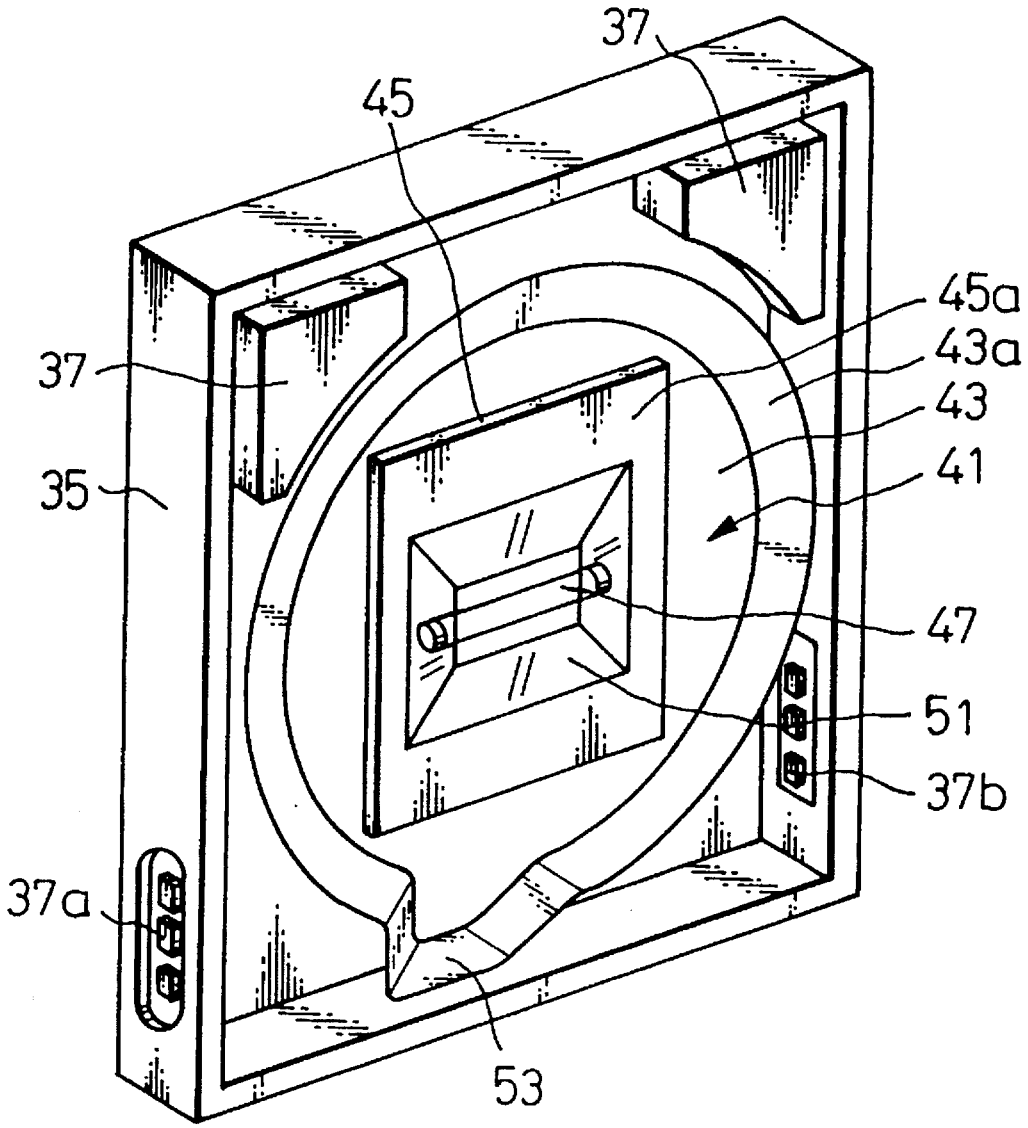
FIG. 2 is a front perspective view of a back frame part of the constellation display clock illustrated in FIG. 1.
Figure 3:
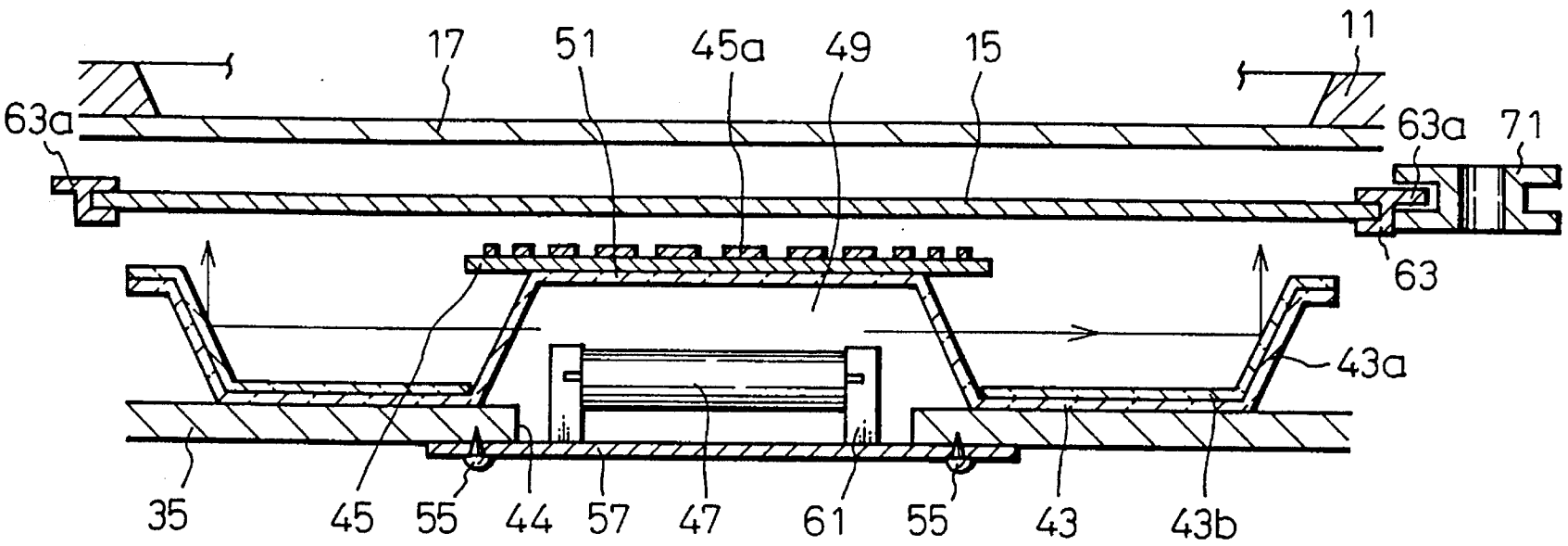
FIG. 3 is a cross-sectional plan view of an illumination part of the constellation display clock illustrated in FIG. 1.

The back frame 35 is shown in FIG. 2 in which the front frame 11 of the constellation clock has been removed. FIG. 3 is a cross-section of the illumination part. The back frame 35 is formed by a hollow frame body having an opening on the front side, in which a constellation disc illumination part 41 and control circuits 37 for driving the constellation disc 15, operating the time representation part and controlling the constellation disc illumination part are provided.

The constellation disc illumination part 41 is formed of a reflection plate 43, a diffusion plate 45 and a fluorescent lamp (light source) 47. The reflection plate 43 has a truncated pyramidal projection 51 (FIG. 3) in the central area thereof for forming a space 49 for accommodating the fluorescent light lamp 47, and the diffusion plate 45 is attached on the upper surface of the projection 51 for homogeneously illuminating the constellation disc 15. The reflection plate 43 is formed of a transparent material and has, except for the projection 51, a reflection film (reflection surface) 43*b* formed by a white coating method or the like. The reflection plate 43 has an extension 53 extending behind the magnitude scale 29, whereby the magnitude scale 29 can be illuminated by a transmitted light of the fluorescent light lamp 47 similarly to the constellation disc 15.

The diffusion plate 45 is formed of a light diffusible and transmittable material of, for example, a rectangular shape, and preferably coated on the upper surface thereof by a film coat 45*a* (FIG. 3) for homogenizing the intensity of the transmitted light. That is, the upper surface of the diffusion plate 45 is divided into a plurality of annular areas of circular or rectangular shape arranged in a concentric manner, to which annular areas various film coats are applied, having light transmittances gradually increasing from a central area to be most bright to an outer peripheral area to be darkest, so that the diffusion plate 45 has substantially a homogeneous brightness all over the surface thereof. That is, the film coat is formed of a film having a high opacity as well as a high reflection factor, whereby the light reflected thereby can be effectively emitted onto the constellation disc 15. For this purpose, a sloped reflecting surface 43*a* is formed on the outer periphery of the reflection plate 43. Accordingly, as shown by an arrow in FIG. 3, the light from the fluorescent light lamp 47 can be effectively reflected by the sloped reflecting surface 43*a* toward the constellation disc 15, after passing through the transparent projection 51.

It is sufficient to provide a single fluorescent light lamp 47 as a light source according to this embodiment, which is fixedly held by a back cover 57 fixed onto the back frame by screws 55 to cover an opening 44 formed on the back frame 35 (described later).

The switches 37*a* on the left side of the back frame are those for the time representation part. In the illustrated embodiment, three switches are arranged in a vertical row. An uppermost switch is a correction mode switch, in which the solar time can be corrected when the upper end thereof is pushed, the sidereal time can be corrected when the lower end thereof is pushed, and a non-sensitive mode can be obtained when it is at an intermediate position. A middle switch is a carry correction switch for hour and a lowermost switch is a carry correction switch for minute, which are operable when the correction mode switch is in a correction mode, respectively, for a solar time or a sidereal time. In this connection, even if the correction mode has been established, the carry correction switches are non-sensitive when the constellation disc 15 is in a standby state in a process of automatic returning or of a quick rotation.

The switches 37*b* on the right side of the back frame are those for the constellation display. In the illustrated embodiment, three switches are arranged in a vertical row. An uppermost switch is an illumination changeover switch, in which a bright illumination is obtained when the upper end thereof is pushed, a dim illumination is obtained when the switch is at an intermediate position, and the illumination disappears when the lower end thereof is pushed.

A middle switch is a quick rotation switch for the constellation disc 15, by which the constellation disc 15 can be rotated stepwise or at a high speed, so that a desired rotational position is readily obtained. A lowermost switch is a preset switch, which is operable in a predetermined period after the constellation disc 15 in a quick rotation caused by a final push of the quick rotation switch stops. If the preset switch is pushed in this period, the constellation disc thereafter rotates in conformity with a sidereal time while the stop position of the constellation disc is used as a base point. Examples of control for the above type clock according to the present invention will be described later.

Structures of the illumination part 41 will be described below with reference to FIG. 3.

In the illumination part 41, a back cover 57, a fluorescent light lamp 47, a reflection plate 43, a diffusion plate 45, a constellation disc 15 and a dial plate 17 are layered in this order from the underside (back side). The fluorescent light lamp 47 is accommodated within a closed space formed between the metallic back cover 57 used as a reflection plate as well as a heat radiation plate and the reflection plate 43 (a space formed of the abovesaid truncated pyramidal projection 61) so that a shield structure is realized for a peripheral region of the fluorescent light lamp in which dust is readily accumulated. Since the fluorescent light lamp 47 is attached to a fluorescent light lamp mount 61 and the back cover 57 is simply and detachably fixed on the back frame 35 by screws 55, it is possible to easily exchange the fluorescent light lamp 47 only by removing the back cover.

On the outer periphery of the constellation disc 15, a constellation disc ring 63 (described later) is fixed for circumferentially driving the former, which is also useful as a seal for preventing the illumination light from leakage through the peripheral region.

The constellation ring 63 has, on the circumference thereof, discrete teeth 63*a* arranged at a constant pitch, each of which has a size fittable depthwise into a groove of a guide pulley 71 described later, so that the ring can be smoothly driven in rotation by the outermost circumference of the guide pulley 71. In the illustrated embodiment, the constellation disc ring 63 is divided into eight sectors for the purpose of facilitating the assembly and machining thereof, each of which has nine teeth 63*a* (total 72 teeth).

Figure 4:
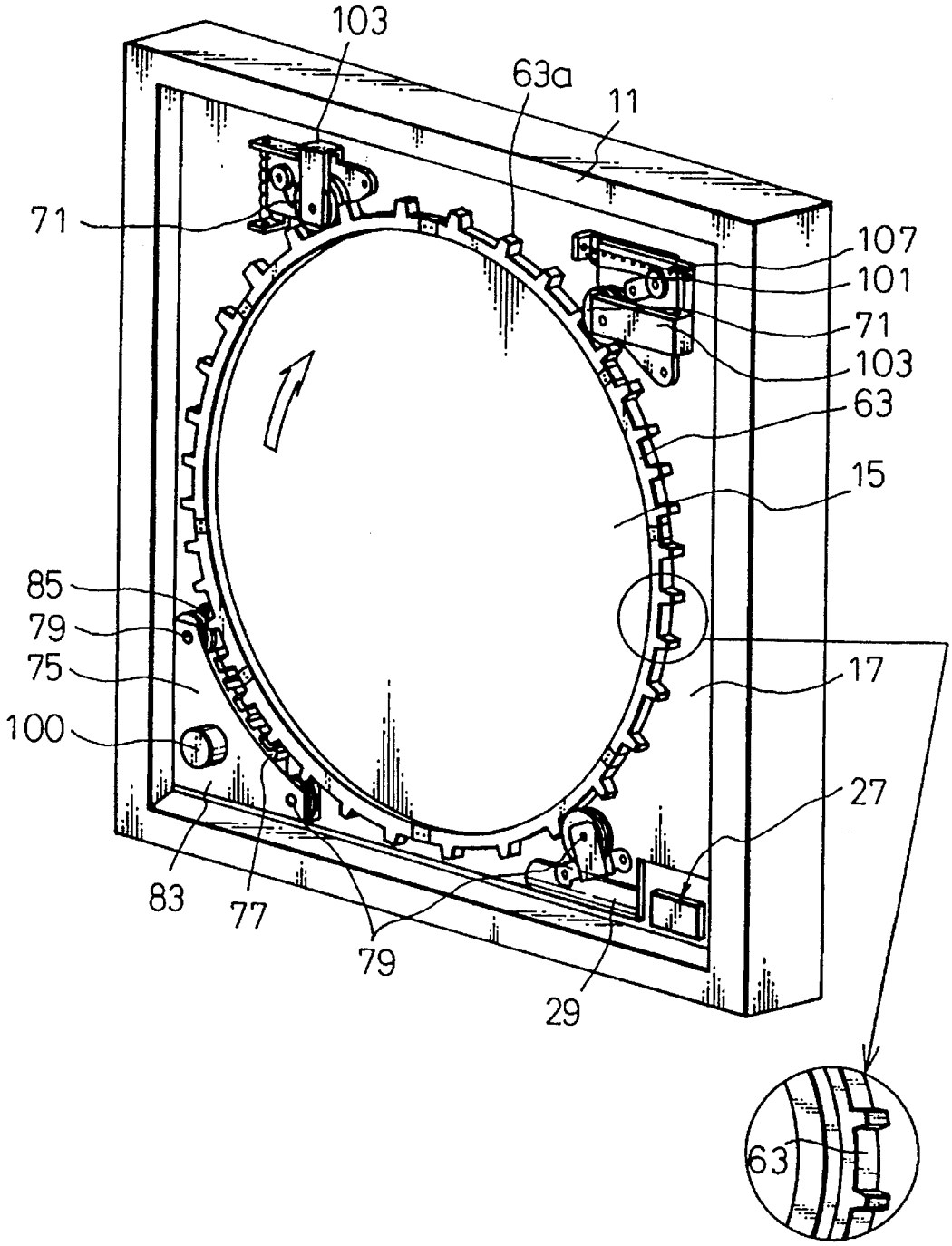
FIG. 4 is a perspective view of a front frame part of the constellation display clock illustrated in FIG. 1 as seen from the back side.

FIG. 4 shows the front frame 11 as seen from the back side thereof, from which it is apparent the constellation ring 63 is structured by eight sector rings connected to form an annular body. As stated above, a total of 72 teeth 63*a* are provided on the constellation disc ring 63, each of which is intermeshed with every fourth tooth of a timing belt 77 of a constellation disc driving part 75 provided at a lower left corner of the drawing. Accordingly one turn of the constellation disc 15 corresponds to 288 (=9×8×4) teeth of the timing belt 77.

The constellation disc ring 63 is circumferentially supported by three stationary guide pulleys 79 and two movable guide pulleys 71 to be smoothly rotatable without any play. Only one of the three stationary guide pulleys 79 positioned in the upper left portion of the constellation disc driving part 75 has a small gap between the same and the constellation disc ring 63 so that rotational friction on the constellation disc ring 63 is minimized and also it functions as a shock absorber for the constellation disc ring 63 when any shocks are applied to the clock.

The timing belt 77 is driven in rotation by a stepping motor 100 as described later. A lower left corner of the dial plate 17 is partially cut away so that an LED and a circuit board (described later) forming the time representation part 27 can be built-in.

Figure 5:
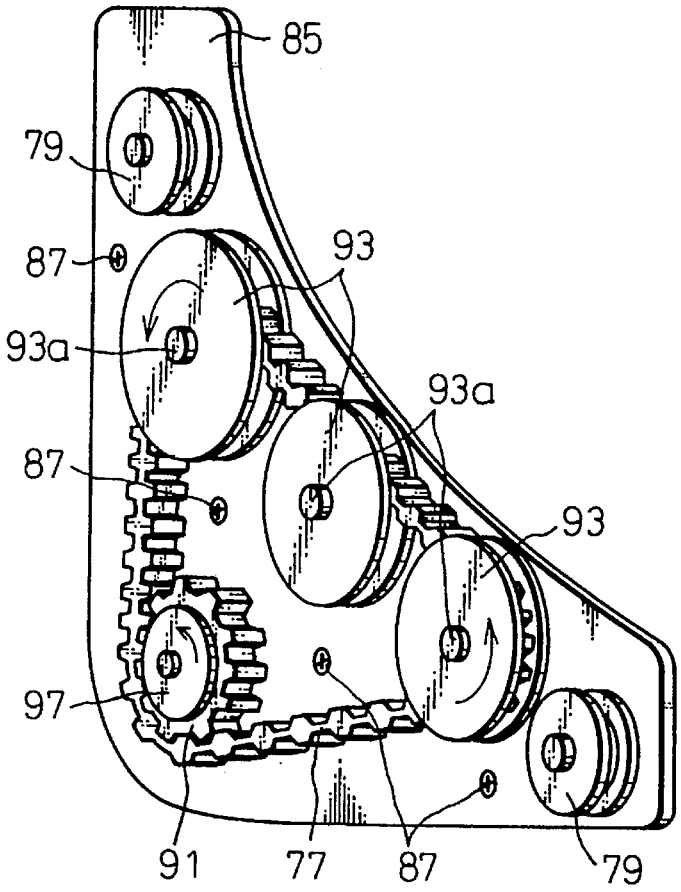
FIG. 5 is a perspective view of a constellation disc drive part of the constellation display clock shown in FIG. 1, a drive upper plate thereof being removed.

FIG. 5 illustrates a structure of the constellation disc driving part 75 in an enlarged scale. The driving part 75 is positioned between an upper plate 83 (FIG. 4) and a lower plate 85 each having substantially the same shape as the other. In FIG. 5, the upper plate 83 is removed. The lower plate 85 is fixed on the front frame 11 by screws 87 with the intervention of the dial plate 17.

Figure 7:
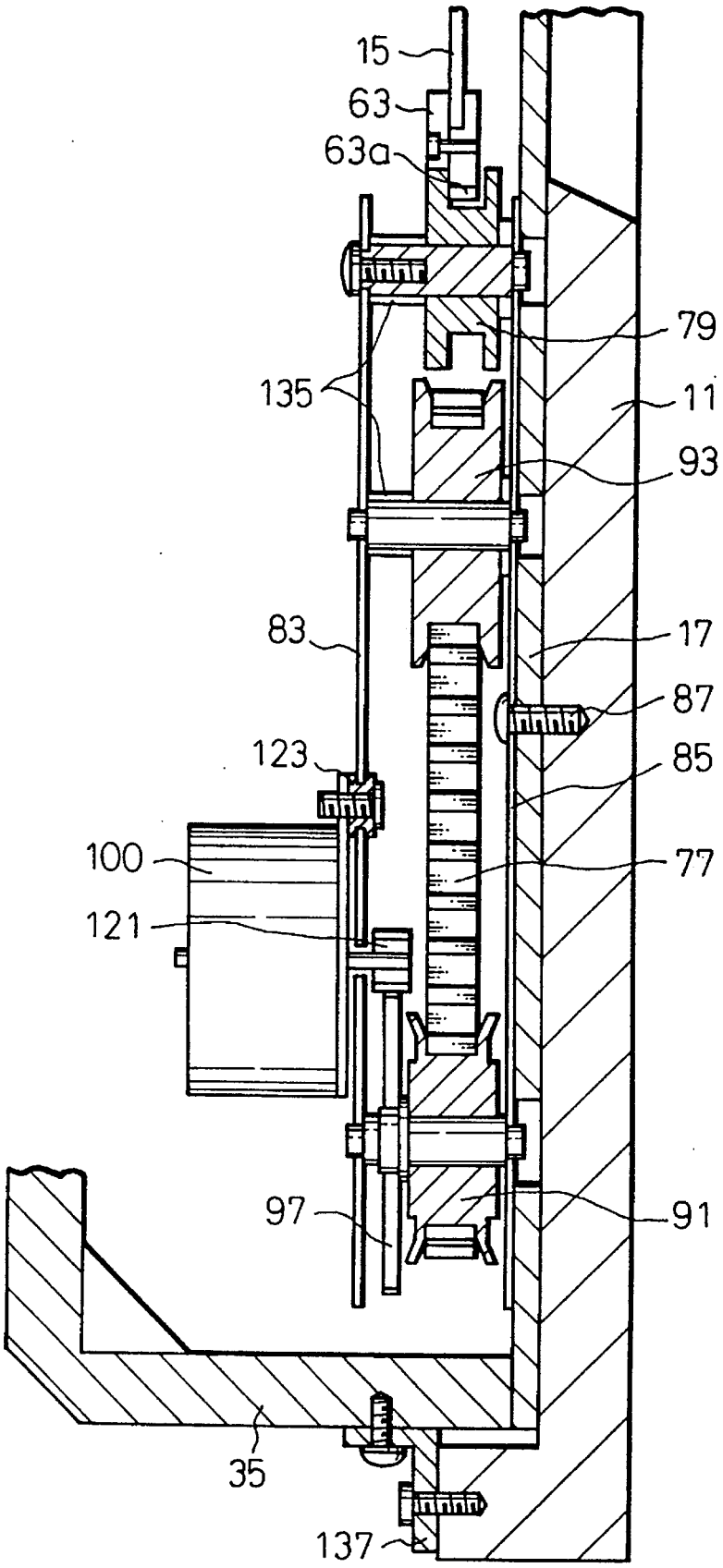
FIG. 7 is an enlarged sectional view of a drive part for the constellation display clock shown in FIG. 1.

The timing belt 77 is of a double toothed type and driven in rotation by a timing pulley 91 connected with a stepping motor 100 (FIG. 7). The timing pulley 91 has, for example, 16 circumferential teeth, whereby one turn of the constellation disc 15 is caused by 18 (288÷16) turns of the timing pulley 91.

The three guide pulleys 93 for the timing belt are arranged so that the double toothed type timing belt 77 extends along an arcuate path corresponding to the curvature of the circumference of the constellation disc ring 63 by the three guide pulleys 93. The respective timing belt guide pulley 93 is supported in rotation about a shaft 93*a* between the upper and lower plates 83, 85. In particular, the timing belt guide pulley 93 positioned at an intermediate position has a diameter capable of preventing the timing belt 77 from disengaging from the teeth of the constellation disc ring 63.

The double toothed type timing belt 77 receives torque by intermeshing with the timing pulley 91 via inner teeth thereof and transmits the same to the constellation disc ring 63 via outer teeth thereof. A spur gear 97 (with 80 teeth in the illustrated embodiment) is fixed to the timing pulley 91.

The same two movable guide pulleys (movable guide pulley unit) 71 are movable in a radial direction so that a play or an excessively tight mounting of the constellation disc due to the expansion of constellation disc 15 or a strain of the constellation disc ring 63 caused by the heat from the illumination or other can be absorbed and the smooth rotation of the constellation disc 15 is guaranteed.

Figure 6:
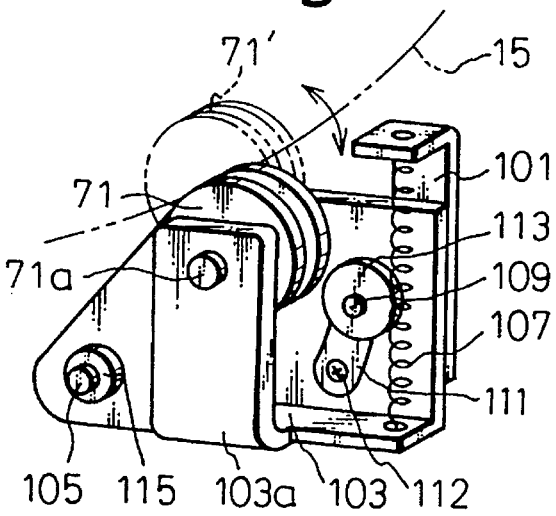
FIG. 6 is a perspective view of a mechanism for a movable guide pulley of the constellation disc in the constellation display clock shown in FIG. 1.

As shown in FIG. 6, a motion mechanism for the respective movable guide pulley 71 has a fixed lower plate 101 fixed onto the front frame 11 while intervening the dial plate 17 and a movable upper plate 103 displaceable relative to the former. The movable upper plate 103 is mounted on the dial plate 17 while being rotatable about a shaft 105, and a pulley shaft 71*a* of the guide pulley 71 is fixedly secured in a fork portion formed between an L-shaped supporting arm 103*a* of the movable upper plate 103 and a body of the movable upper plate 103. The guide pulley 71 is rotatably held on the pulley shaft 71*a*. A stretch type coil spring 107 is attached between the movable upper plate 103 and the fixed lower plate 101 so that the movable upper plate 103, i.e., the guide pulley 71 is always biased counterclockwise toward a position 71' shown in FIG. 6.

A rotational position (rotational angle) of the movable upper plate 103 is restricted by an elongated hole 111 formed on the movable upper plate 103 and a stop screw 109 to be inserted into it. That is, an expanded head 113 of the stop screw 109 (it may be formed by a separate part such as a washer) projects outward from the elongated hole 111, whereby the movable upper plate 103 is pivotable about the shaft 105 as a fulcrum until the stop screw 109 abuts the opposite ends of the elongated hole 111.

A small gap is provided between the movable upper plate 103 and each of the expanded head (or a washer) 113 of the stop screw 109 and a washer 115 provided on the shaft 105, so that the movable upper plate 103 is smoothly rotatable.

Thus, the constellation disc 15 is always pressingly held from the circumference by substantially a constant force caused by the stretch type coil spring 107.

While the elongated hole 111 on the movable upper plate 103 has a sufficient length for facilitating the built-in operation of the constellation disc ring 63, it is not easily dislocated by a shock once the built-in operation has been completed by the action of the expanded head of the stop screw 109.

Next, the structure of a driving system will be explained with reference to FIG. 7.

A pinion 121 having, for example, 12 teeth is fixed on an output shaft of the stepping motor 100 secured on the drive upper plate 83. The stepping motor 100 rotates one turn by, for example, 48 pulses. In the illustrated embodiment, the pulse number necessary for rotating the constellation disc 15 one turn is 18×(80÷12)×48=5760 pulses, because it is defined that the constellation disc 15 rotates one turn while the timing pulley 91 rotates 18 turns. That is, the constellation disc 15 accurately rotates one turn per one sidereal day if one pulse is issued at every 15th sidereal second.

The stepping motor 100 is attached on the drive upper plate 83 via shock absorbing rubber bushes 123 (while only one is illustrated in FIG. 7 for clarifying the drawing, actually two are used at a pitch of 180°) so that the vibration of the stepping motor is hardly transmitted to the clock body through the drive upper plate 83.

The constellation disc 15 is adapted to be rotatable only in the direction corresponding to a motion of constellations (counterclockwise in this embodiment), whereby the displaying error due to a backlash in gear trains or timing belts can be minimized.

The rotational direction of the constellation disc 15 is reversed (clockwise) if the rotational center thereof is selected to be the celestial south pole.

In FIG. 7, reference numerals 135, 137, respectively, denote spacers for maintaining a constant distance between the drive upper plate 83 and the drive lower plate 85 and (upper and lower two) L-shaped members for fixing the front frame 11 and the back frame 35 with each other.

Figure 8:
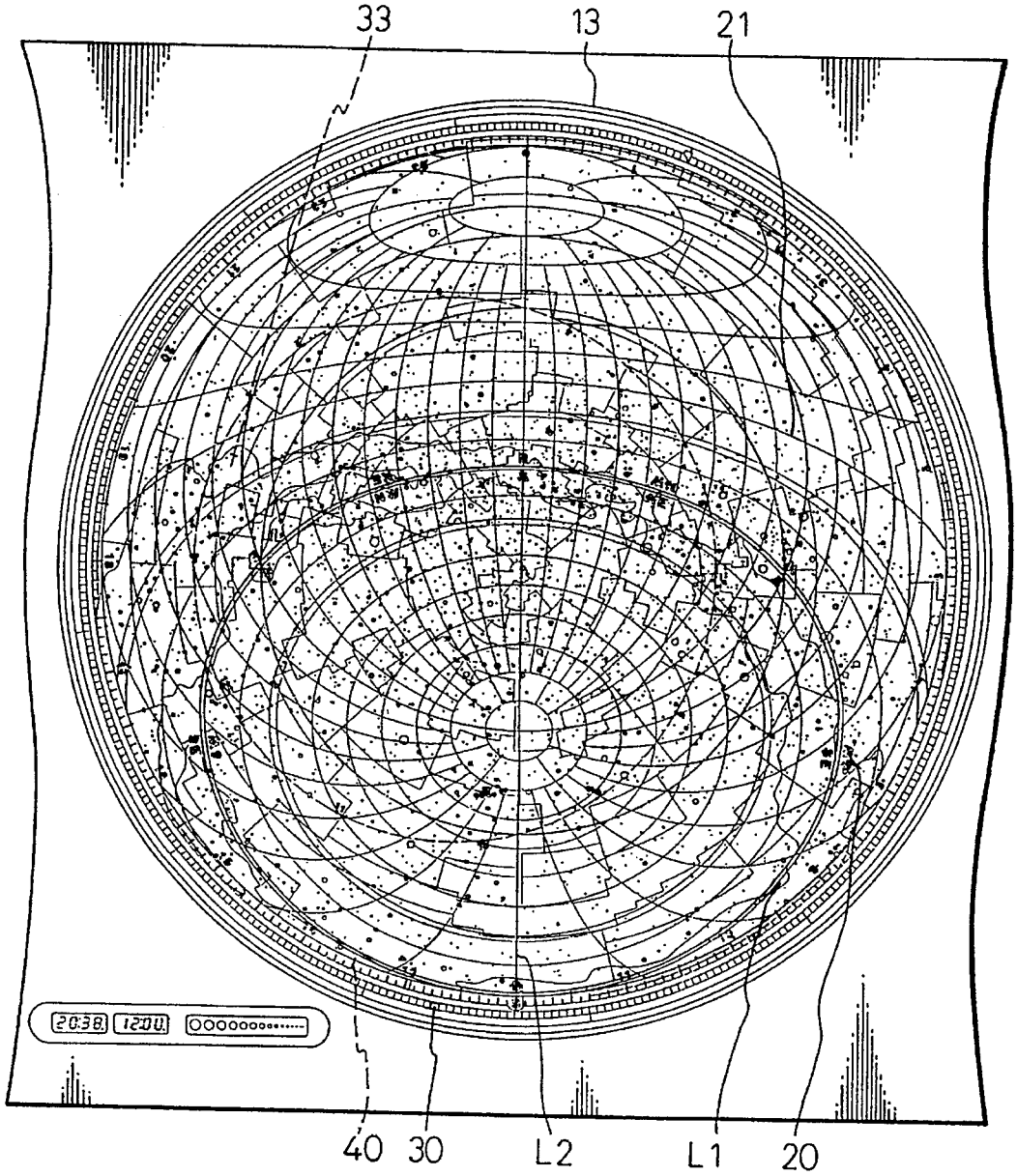
FIG. 8 is a front view of the constellation display clock according to the present invention.

FIG. 8 is an illustration of a front view of the constellation disc part of the constellation display clock according to the present invention, but it is impossible to reproduce details of constellations or other due to the scale of the drawing.

Figure 9:
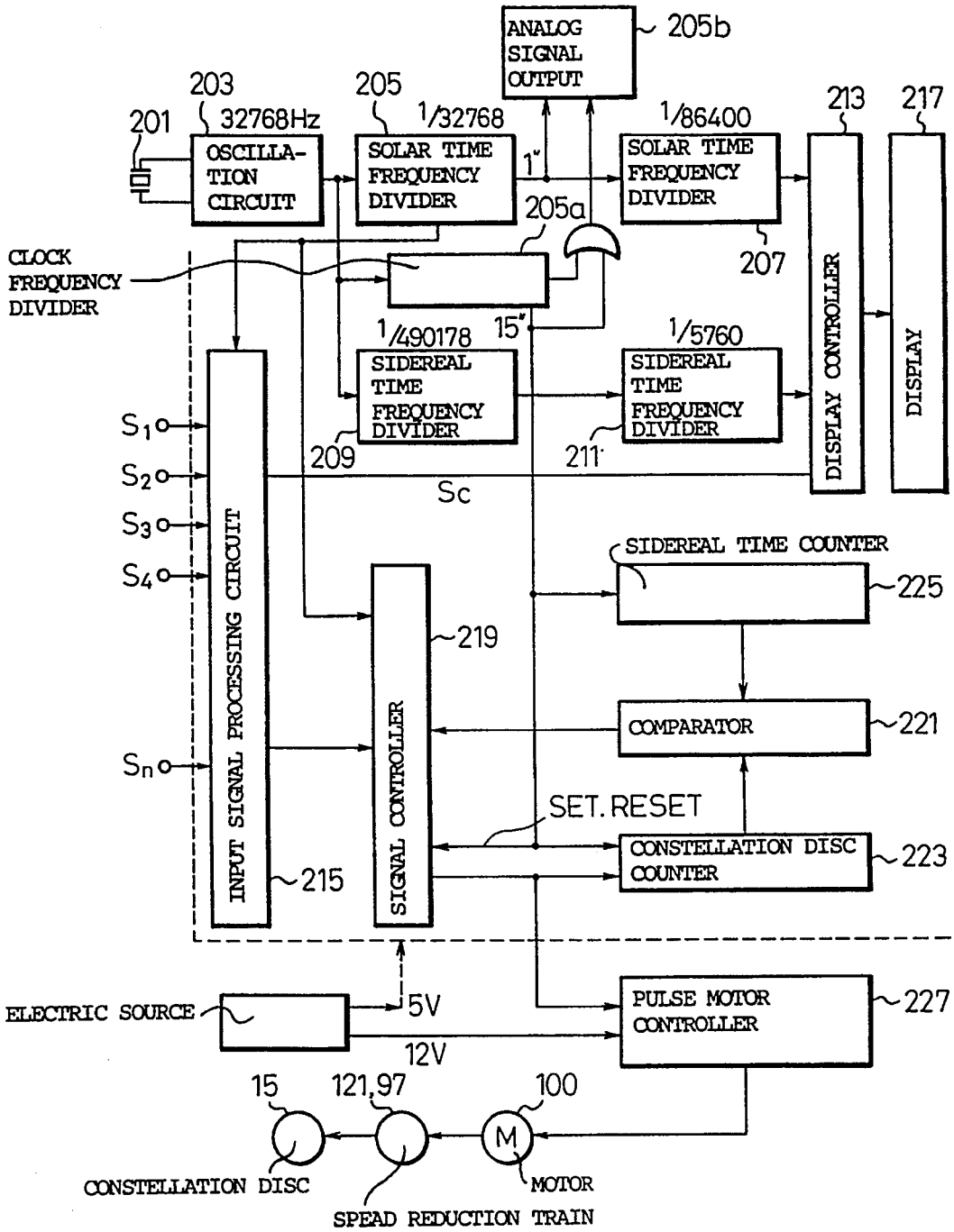
FIG. 9 is a block diagram of a driving device for the constellation display clock according to the present invention.

FIG. 9 illustrates a control system for the constellation display clock included in the present invention, which will be described below.

According to a feature of the present invention, an oscillation circuit 203 including a single quartz oscillator 201 is used. The oscillation circuit 203 outputs, for defining a solar time and a sidereal time, a frequency of 32768 Hz ($=2^{15}$) inherent to a quartz oscillator 201. The output frequency is divided by a first solar time frequency divider 205 into 1/32768 so as to obtain one second of a solar time. Then the one second signal from the frequency divider 205 is divided by a second solar time frequency divider 207 into 1/86400 (∴one day=86400 seconds) to obtain a solar time display signal for one day (24 hour).

On the contrary, the output from the oscillation circuit 203 is divided by a first sidereal time frequency divider 209 into 1/490178 to obtain a 15 second signal of a sidereal time. That is, while the 15 second signal of a solar time is originally obtained by dividing 32768 Hz of the frequency divider 205 into 1/491520, the 15 second signal of a sidereal time is obtained by dividing into 1/490178 (=2×13×17×1109). This value is very close to an ideal value calculating from a fact that the number of days in one sidereal year is larger by one day than that in one solar year, and is an ideal approximation obtained by dividing a frequency output from a quartz oscillator which is only one existing oscillator capable of outputting such a larger frequency. In this regard, a well-known divisional ratio for 15 seconds of a sidereal time is as follows: (1/32768×15)×(366.2422/365.2422)=(1/490177.94 . . . )

Accordingly, an annual error of sidereal time is only 4 seconds/year order lag, by which it will be understood that the above approximation is very close to an ideal value as far as the frequency division is possible. Of course, this is accurate enough for a sidereal time of a constellation display clock.

Further the output from the frequency divider 209 is divided by a second sidereal time frequency divider 211 into 1/5760 to obtain a signal for representing one sidereal day (24 hour).

Figure 10:
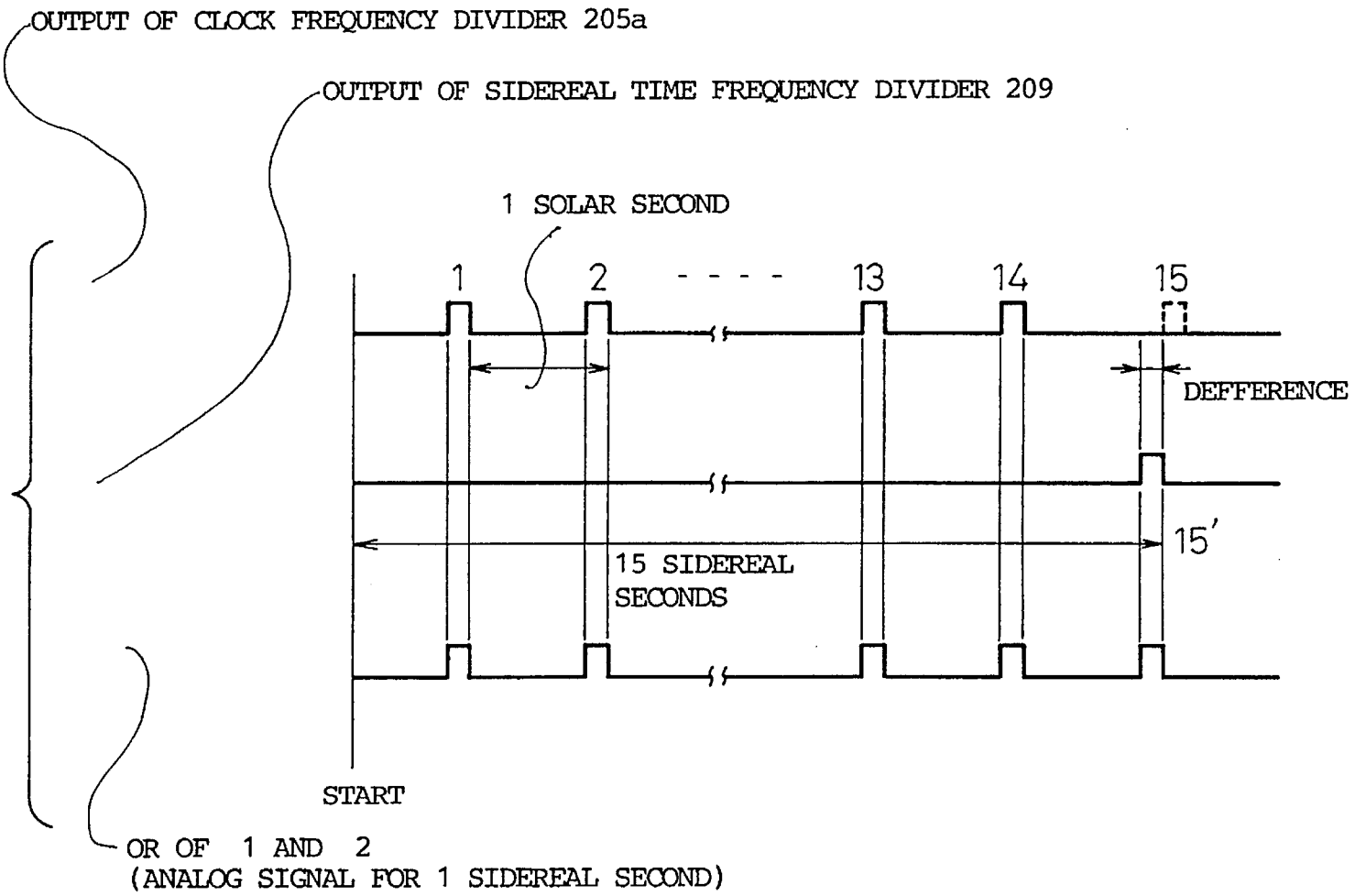
FIG. 10 is a time chart for explaining a process for extracting an output one second pulse signal for a sidereal time analog signal.

It is adapted that one second pulse signals **205*b* are also output from the first solar time frequency divider 205 and the first sidereal time frequency divider 209, having a predetermined duty width used for the respective analog signals. Of them, a first one second pulse signal of a sidereal time is issued in synchronism with issuance of a first 15 second pulse signal of a sidereal time and fourteen signals are sequentially issued at every one second of a solar time so that the first through fourteenth one sidereal seconds are approximated only by a simple combination of frequency divisional ratios. That is, a solar time and a sidereal time has a slight difference as described above. Strictly speaking this difference must be corrected at every one second. However, the correction is carried out at every 15th sidereal second in the present invention. The sidereal time is shorter by about 3 min 56 sec in solar time per day than the solar time. This means that the 15 sidereal seconds are slightly shorter by about 4/100 second than the 15 solar seconds. Accordingly, the count of the sidereal second is carried out at a pitch of one solar second until the fourteenth second has been reached (therefore the difference is gradually accumulated until the count has reached the fourteenth second). The frequency divider 209 is reset by the fifteenth sidereal second so that the output and logic sum are obtained, whereby a period between the adjacent two 15 sidereal second signals can be represented as a series of one second signals (FIG. 10**).

As stated above, a period between the approximated fourteenth and fifteenth sidereal seconds (from 14 to 15') is every time shorter than the actual one solar second (from 14 to 15) as well as shorter than the actual one sidereal second. Thus, the one sidereal second signal is corrected at every 15th second to correspond with the actual sidereal time. It will be apparent that the difference of times in the above description is in fact a very small value if a fact is taken into account that the difference between the sidereal and solar times is as small as 4 minutes per day (less than 0.3%).

In the present invention, since a clock (product) is adapted so that the display 23 for representing a solar time and a display 25 for representing a sidereal time simultaneously flash at every seconds, a time differential can be recognized by eyes only by the difference between the flash instants when the time passes from a fourteenth second to a fifteenth second (but the flashes occur at substantially the same time). However, since this is corrected at every 15th sidereal second, there is no problem in practice.

Signals for representing a solar time and signals for representing a sidereal time issued from the second solar time frequency divider 207 and the second sidereal time frequency divider 211 are transmitted to a display controller 213. A control signal Sc is input to the controller 213 from an input signal processing circuit 215 and carries out various control operations such as flash of a display device 217 (representation part 27) or on-off of illumination in accordance with various operational signals S1, S2, S3 . . . Sn input to the input signal processing circuit 215 (for example, a signal for quick rotation of the constellation disc 15, a signal for demonstrative quick rotation of the constellation disk 15 and a preset signal, in the illustrated embodiment).

By pushing a quick-rotation button (one included in the button groups **37*a*, 37*b*), the user can quickly rotate the constellation disc 15 desired turns (angle) through a pulse motor controller 227 (FIG. 9**) at any time and position at a speed as fast as about one thousand times the normal rotational speed (if quick-rotated at 64 pps (solar time), the speed is 64×15×365.2422/366.2422≈ 957.4 times).

Alternatively, by pushing a DEMO button (one included in the button groups **37*a*, 37*b*), one can rotate the constellation disc 15** at any time and position by a desired angle (for example, one additional turn quick rotation).

In the clock according to the present invention, the constellation disc 15 is adapted to automatically start one turn quick rotation at every just time (for example, 1 o'clock or 2 o'clock at which minute and second return to zero). This is for the purpose of enhancing a demonstrative function. The solar time and the sidereal time are digitally represented in the solar time display 23 and the sidereal time display 25 of the representation part 27, respectively.

Other signals such as a quick rotation signal or a preset signal are input to the input signal processing circuit 215 by operating the switches 37*a*, 37*b* (FIGS. 1 and 2). A signal controller 219 connected with the input signal processing circuit 215 controls a period, a duty width and a pulse number of the stepping motor 100 for driving the constellation disc 15 in accordance with an information signal from the input signal processing circuit 215, a clock signal from the first solar time frequency divider 205 and a coincidence signal from a comparator 221, and outputs a set or reset signal for a constellation disc counter 223.

The constellation disc counter 223 counts the 15 sidereal second signals and the number of pulses for driving the stepping motor from the signal controller 219. The constellation disc counter 223 can count 5760 pulses at the maximum and the output therefrom is transmitted to the comparator 221 for the comparison with the output information from a sidereal time counter 225.

The sidereal time counter 225 counts the 15 sidereal second signals. It can count 5760 pluses at the maximum, which output is transmitted to the comparator 221.

The comparator 221 issues an output "1" when the value of the sidereal time counter 225 and the value of the constellation disc counter 223 coincide with each other, for example, so that the quick rotation of the constellation disc returns to a normal rotation. That is, while the constellation disc 15 is maintained in a state ready for the quick rotation by the operation of one of the switches 37*a*, 37*b*, the quick rotation of the constellation disc 15 is automatically interrupted in accordance with the output signal "1" from the comparator 221 as stated later to be returned to a normal operation, and simultaneously therewith a difference between the sidereal time initially set and a position of the constellation disc (time differential) is automatically corrected by a quick rotation.

During the normal operation, an output from the sidereal time counter 225 and an output from the constellation counter 223 always coincide with each other.

A pulse motor controller 227 controls a normal rotation, reverse rotation or a save of electric power during the normal operation of the stepping motor 100 in accordance with control signals from the signal controller 219.

Based on pulse motor signals controlled in accordance with the input states, the constellation disc 15 is made to rotate through the speed reduction train (121, 97, 91 or other). During the normal operation, the constellation disc 15 rotates one turn by 5760 pulses.

Figure 11:
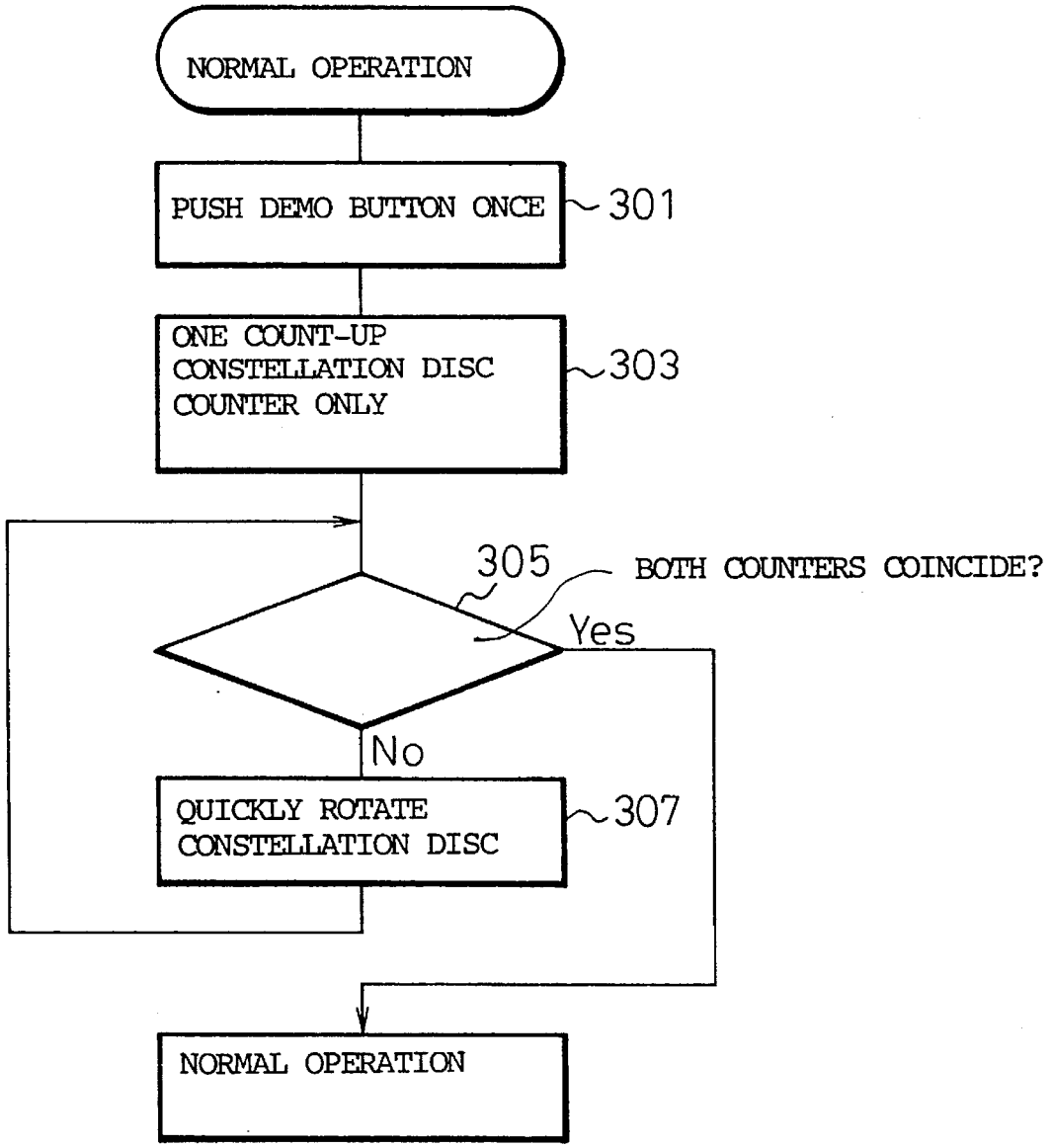
FIG. 11 is a flow chart for a quick rotation of the constellation display clock according to the present invention.

FIG. 11 illustrates a flow chart for a demonstrative quick rotation, which is one of control systems of the present invention.

When a DEMO button (one of switches in groups 37*a*, 37*b*) is pushed once during the usual (normal) operation of the constellation disc 15 (step 301), the constellation disc 15 rotates 1/5760 turn, whereby the constellation disc counter 223 is one count-up (step 303).

Since the constellation disc counter is one count-up at step 303 compared to the sidereal time counter, values of the counters 225, 223 do not coincide with each other in the comparator 221. Accordingly, the constellation disc 15 makes a quick rotation corresponding to (5959+α) pulses directly after the DEMO button is pushed so that the values of both the counters coincide with each other, whereby the output "1" is issued from the comparator 221 (note α is the number of the 15 sidereal second signal pulses input during the (5759+α) pulse quick rotation of the constellation disc 15). Thereafter, the constellation disc returns to a normal operation in accordance with the output "1" from the comparator 221 (steps 305, 307). Thus, the position of the constellation disc 15 deviated by the demonstrative quick rotation is restored to a present position (a present position defined by using, as an initial position, a position at which the sidereal time and the constellation disc have been initially coincided).

Figure 12:
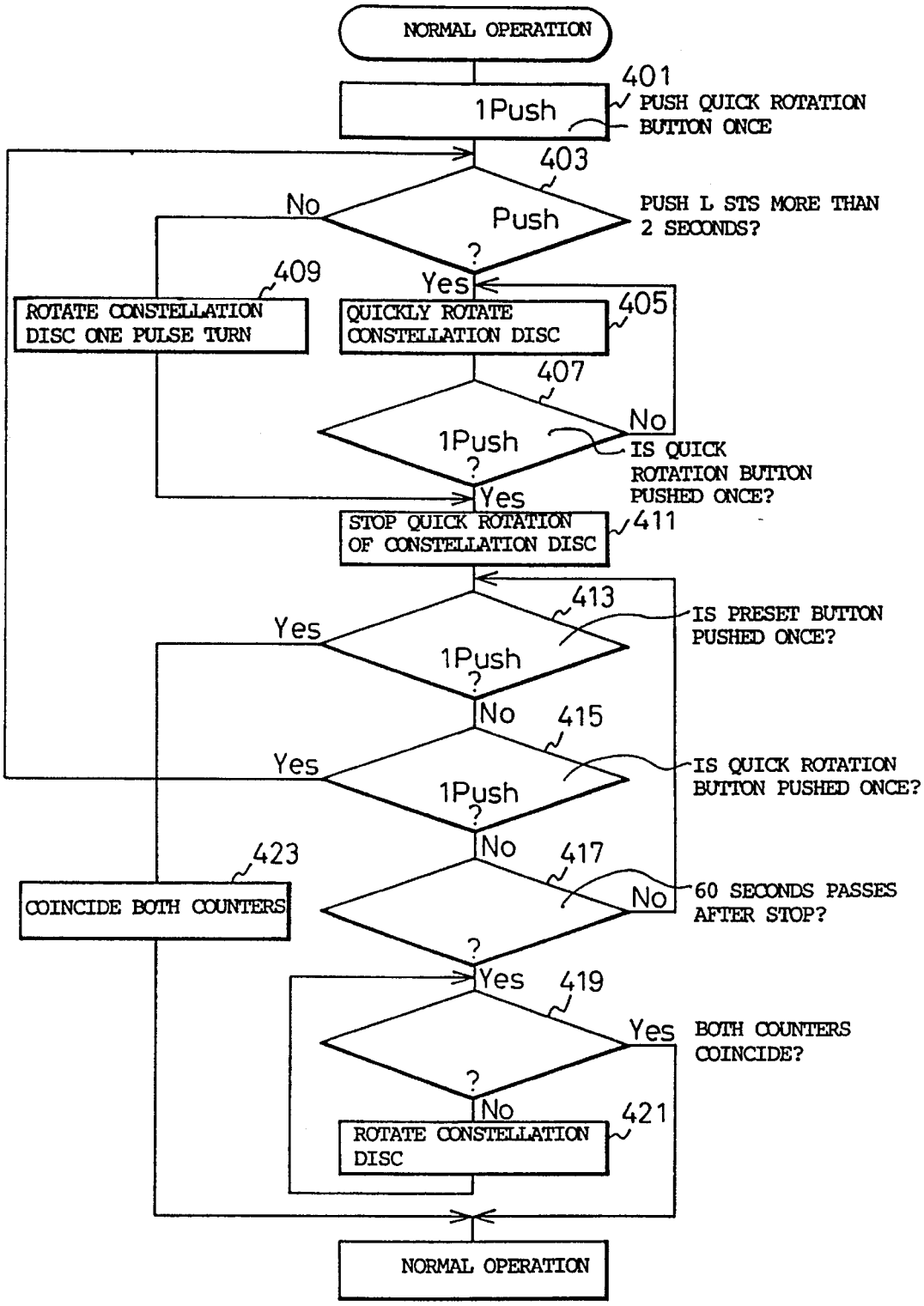
FIG. 12 is a flow chart for a quick rotation and a continuous quick rotation of the constellation display clock according to the present invention.

Next, a quick rotation and a preset operation of the constellation disc are explained with reference to FIG. 12. When the quick rotation button (one of the switches in groups 37*a*, 37*b*) is pushed once during the normal operation of the constellation disc 15 (step 401), the constellation disc 15 rotates 1/5760 turn, whereby the constellation disc counter 223 is one count-up. At that time, a 60 second timer (not shown) is actuated to start the count-down.

60 seconds passes before a preset button (one of switches in groups 37*a*, 37*b*) is pushed or the quick rotation button is pushed.

If no button is pushed, since the constellation counter is one count-up compared to the sidereal time counter, values of both the counters 225, 223 do not coincide with each other in the comparator 221. Accordingly, when 60 seconds lapses after the quick rotation button has been pushed, the constellation disc makes a quick rotation corresponding to (5759+α) pulses so that the values of the counters coincide with each other, whereby the comparator 221 can issue an output "1". Thereafter, the constellation disc 15 returns to the usual operation in which a position thereof deviated by the quick rotation is restored to a present position.

The preset button (one of switches in groups 37*a*, 37*b*) is effective only within 60 seconds after the quick rotation button has been finally pushed, which acts so that the contents of the constellation counter and the sidereal time counter are forcibly coincided with each other (step 319) to restore the disc rotation to the normal operation.

If the quick rotation button is pushed n times, it will be apparent that the constellation disc makes a rotation corresponding to (5760−n+α) pulses and returns to the normal operation. In this regard, while the timer is set to 60 seconds in this example, the set time may be optionally selected.

Next, the operation of a continuous quick rotation will be explained with reference to FIG. 12.

When one of the quick rotation buttons (the switches in group 37*a* or 37*b*) is pushed once during the usual (normal) operation of the constellation disc 15 (step 401) and maintained in the pushed state more than 2 seconds (step 403), the constellation disc 15 unconditionally continues the quick rotation until the quick rotation button is again pushed once.

If there is one push of the quick rotation button (step 407), the quick rotation of the constellation disc 15 is interrupted (step 411) and steps after 309 are carried out (steps 413 through 421).

The constellation disc can return from a present position to a position to be located at the present instant, by counting the 15 sidereal second pulses with the sidereal time counter 225 and by counting the 15 sidereal second pulses and the pulses for output of the pulse motor with the constellation disc counter 223, which results are compared with each other in the comparator 221.

The above operation can be carried out either by a hardware or a software.

As stated above, according to the present invention, since a constellation disc is visible from the front thereof through a transparent dial plate, the complete constellation is reproduced without interfering with hour and minute hands, as is the conventional case.

Also the constellation disc is accurately rotatable in accordance with a predetermined sidereal time by a driving torque from a stepping motor through a simple power transmission mechanism.

Since a backlight is substantially homogeneously emitted from the backside of the constellation disc, the constellation disc can be illuminated without unevenness, whereby a constellation display clock is proposed, which has superiorities in aesthetic and observative view points.

According to the present invention, a solar time clock and a sidereal time clock are driven by an output from a single oscillator (oscillation circuit) divided into the respective frequencies suitable therefor, so that the abovesaid object is achievable.

Since the deviation between the sidereal time and the constellation disc is automatically corrected, the solar time and the sidereal time can substantially always correspond with each other, whereby the actual constellations at that instant can be always reproduced. In addition, since the constellation disc can be rotated and controlled independent from the solar time display and the sidereal time display, various functions such as a demonstrative quick rotational operation or an automatic quick rotation returning operation can be realized.

CAPABILITY OF EXPLOITATION IN INDUSTRY

A clock according to the present invention can be used not only as a wall clock or a desk clock while using a function inherent to clock proper but also as a teaching aid for celestial spheres and constellations, and it has a wide capability for an interior design of a room.

We claim:

1. A clock having a constellation display, comprising a clock body having a front frame and a back frame fixed to the front frame, an opening in the front frame, a transparent dial plate fixed to the front frame covering said opening, a transparent constellation disc rotatably mounted in the clock body behind the dial plate so that it is viewable through the dial plate and the opening, said disc having an annular toothed member on the circumference thereof, support means in the clock body for rotatably supporting the constellation disc only at an outer peripheral surface thereof and at a plurality of discrete locations, a light source behind the constellation disc and between the front and back frames for illuminating the constellation disc from behind, means for homogeneously illuminating the constellation disc, and drive means engageable with the annular toothed member of the constellation disc for rotatably driving said disc with respect to said fixed dial plate.

2. The clock of claim 1, wherein said transparent dial plate has scale marks on the periphery thereof representing the months and days of the year.

3. The clock of claim 1, wherein the means for homogeneously illuminating the constellation disc comprises a diffusion member behind the constellation disc and between the constellation disc and the light source for substantially homogeneously diffusing the light from the light source.

4. The clock of claim 3, including a reflection means between the light source and the constellation disc for reflecting the light from the light source toward the constellation disc.

5. The clock of claim 1, wherein a solar time display and a sidereal time display are provided on the front frame adjacent the constellation disc.

6. The clock of claim 1, wherein a magnitude scale is provided on the front frame that represents the magnitudes of fixed stars displayed on the constellation disc.

7. The clock of claim 1, wherein a single fluorescent lamp is used as the light source.

8. The clock of claim 7, wherein an opening is provided in the back frame and a back cover, detachably fitted to the opening, provides a mounting surface for the fluorescent lamp.

9. The clock of claim 1, wherein the drive means for constellation disc comprises a stepping motor fixed to the back frame having an output shaft, a timing pulley connected with the output shaft of the stepping motor and driven in rotation thereby, and a timing belt driven in rotation by the timing pulley and engageable with the toothed member of the constellation disc.

10. The clock of claim 9, including a plurality of guide pulleys for guiding the timing belt in conformity with the path of rotation of the annular toothed member of the constellation disc.

11. The clock of claim 1, wherein the support means for rotatably supporting the constellation disc comprises at least one movable guide pulley and at least one stationary guide pulley engageable with the outer peripheral surface of the annular toothed member of the disc.

12. The clock of claim 11, wherein the movable guide pulley is pivotably displaceable inwardly in a radial direction relative to the disc.

13. The clock of claim 12, including a spring means for biasing the movable guide pulley inwardly in the radial direction.

14. The clock of claim 13, including a stop means for restricting the radial displacement of the movable guide pulley.

15. The clock of claim 14, including a plurality of movable guide pulleys and cooperating stop means spaced around the outer outer peripheral surface of the annular toothed member of the constellation disc.

16. The clock of claim 5, wherein the solar time display and the sidereal time display are driven by a single oscillation circuit comprising a single oscillator, and frequency dividers are provided for dividing a frequency of the oscillation circuit into predetermined frequencies suitable for displaying the solar time and the sidereal time, respectively.

17. The clock of claim 16, including means for automatically correcting a time differential between the sidereal time display and the constellation disc.

* * * * *